US006091374A

United States Patent [19]

Barnes

[11] Patent Number: 6,091,374

[45] **Date of Patent: *Jul. 18, 2000**

[54] ULTRA-WIDEBAND MAGNETIC ANTENNA

[75] Inventor: Mark Andrew Barnes, Madison, Ala.

[73] Assignee: Time Domain Corporation, Huntsville, Ala.

[ * ] Notice: This patent issued on a continued prosecution application filed under 37 CFR 1.53(d), and is subject to the twenty year patent term provisions of 35 U.S.C. 154(a)(2).

[21] Appl. No.: 08/925,178

[22] Filed: Sep. 9, 1997

[51] Int. Cl.[7] ..... H01Q 1/28

[52] U.S. Cl. ..... 343/787; 343/767; 343/770

[58] Field of Search ..... 343/767, 787, 343/769, 770, 768

[56] References Cited

U.S. PATENT DOCUMENTS 3,031,665 4/1962 Marié ..... 343/770

FOREIGN PATENT DOCUMENTS 1134384 4/1957 France .

WO 91/13370 9/1991 WIPO ..... G01S 13/04

OTHER PUBLICATIONS

Chen, C. and Alexopoulos, N.G., "Radiation by Aperture Antennas of Arbitrary Shape Fed by a Covered Microstrip Line," *IEEE Antennas and Propagation Society International Symposium Digest*, vol. 4, Jun. 18, 1995, pp. 2066–2069.

Cox, R.M. and Rupp, W.E., "Circularly Polarized Phased Array Antenna Element," *IEEE Transactions on Antennas and Propagation*, Nov. 1970, pp. 804–807.

Papierz, A.B. et al., "Analysis of antenna structure with equal E– and H– plane patterns," *Proc. Of the Institution of Electrical Engineers*, vol. 124, No. 1, Jan. 1977, pp. 25–30.

Shlager, K.L. et al., "Optimization of Bow–Tie Antennas for Pulse Radiation," *IEEE Transactions on Antennas and Propagation*, vol. 42, No. 7, Jul. 1994, pp. 975–982.

Lamensdorf, D. and Susman, L., "Baseband–Pulse–Antenna Techniques," *IEEE Antennas and Propagation Magazine*, vol. 36, No. 1, Feb. 1994, pp. 20–30.

*Primary Examiner*—Don Wong
*Assistant Examiner*—James Clinger
*Attorney, Agent, or Firm*—Sterne, Kessler, Goldstein & Fox PLLC

[57] ABSTRACT

An ultra-wideband magnetic antenna includes a planar conductor having a first and a second slot about an axis. The slots are substantially leaf-shaped having a varying width along the axis. The slots are interconnected along the axis. A cross polarized antenna system is comprised of an ultra-wideband magnetic antenna and an ultra-wideband dipole antenna. The magnetic antenna and the dipole antenna are positioned substantially close to each other and they create a cross polarized field pattern. The present invention provides isolation between a transmitter and a receiver in an ultra-wideband system. Additionally, the present invention allows isolation among radiating elements in an array antenna system.

14 Claims, 9 Drawing Sheets

ULTRA-WIDEBAND MAGNETIC ANTENNA

BACKGROUND OF THE INVENTION

1. Field of the Invention

This invention generally relates to antennas, and more specifically to an ultra-wideband magnetic antenna.

2. Related Art

Recent advances in communications technology have enabled communication and radar systems to provide ultra-wideband channels. Among the numerous benefits of ultra-wideband channels are increased channelization, resistance to jamming and low probability of detection.

The benefits of ultra-wideband systems have been demonstrated in part by an emerging, revolutionary ultra-wideband technology called impulse radio communications systems (hereinafter called impulse radio). Impulse radio was first fully described in a series of patents, including U.S. Pat. No. 4,641,317 (issued Feb. 3, 1987), U.S. Pat. No. 4,813,057 (issued Mar. 14, 1989) and U.S. Pat. No. 4,979,186 (issued Dec. 18, 1990) and U.S. patent application Ser. No. 07/368,831 (filed Jun. 20, 1989) all to Larry W. Fullerton. These patent documents are incorporated herein by reference.

Basic impulse radio transmitters emit short Gaussian monocycle pulses with tightly controlled pulse-to-pulse intervals. Impulse radio systems can use pulse position modulation, which is a form of time modulation in which the value of each instantaneous sample of a modulating signal is caused to modulate the position in time of a pulse.

For impulse radio communications, the pulse-to-pulse interval is varied on a pulse-by-pulse basis by two components: an information component and a pseudo-random code component. Generally, spread spectrum systems make use of pseudo-random codes to spread the normally narrow band information signal over a relatively wide band of frequencies. A spread spectrum receiver correlates these signals to retrieve the original information signal. Unlike spread spectrum systems, the pseudo-random code for impulse radio communications is not necessary for energy spreading because the monocycle pulses themselves have an inherently wide bandwidth. Instead, the pseudo-random code is used for channelization, energy smoothing in the frequency domain and jamming resistance.

The impulse radio receiver is a homodyne receiver with a cross correlator front end. The front end coherently converts an electromagnetic pulse train of monocycle pulses to a baseband signal in a single stage. The baseband signal is the basic information channel for the basic impulse radio communications system, and is also referred to as the information bandwidth. The data rate of the impulse radio transmission is only a fraction of the periodic timing signal used as a time base. Each data bit time position modulates many pulses of the periodic timing signal. This yields a modulated, coded timing signal that comprises a train of identical pulses for each single data bit. The cross correlator of the impulse radio receiver integrates multiple pulses to recover the transmitted information.

Ultra-wideband communications systems, such as the impulse radio, poses very substantial requirements on antennas. Many antennas are highly resonant operating over bandwidths of only a few percent. Such "tuned," narrow bandwidth antennas may be entirely satisfactory or even desirable for single frequency or narrow band applications. In many situations, however, wider bandwidths may be required.

Traditionally when one made any substantial change in frequency, it became necessary to choose a different antenna or an antenna of different dimensions. This is not to say that wide band antennas do not, in general, exist. The volcano smoke unipole antenna and the twin Alpine horn antenna are examples of basic wideband antennas. The gradual, smooth transition from coaxial or twin line to a radiating structure can provide an almost constant input impedance over wide bandwidths. The high-frequency limit of the Alpine horn antenna may be said to occur when the transmission-line spacing $d>\lambda/10$ and the low-frequency limit when the open end spacing $D<\lambda/2$. These antennas, however, fail to meet the obvious goal of transmitting sufficiently short bursts, e.g., Gaussian monocycle pulses. Also, they are large, and thus impractical for most common uses.

A broadband antenna, called conformal reverse bicone antenna (hereinafter referred to as the bicone antenna) suitable for impulse radio was described in U.S. Pat. No. 5,363,108 to Larry Fullerton. FIG. 1 illustrates a front view of a bicone antenna 100. The bicone antenna 100 radiates burst signals from impulses having a stepped voltage change occurring in one nanosecond or less. The bicone antenna 100 is basically a broadband dipole antenna having a pair of triangular shaped elements 104 and 108 with closely adjacent bases. The base and the height of each element is approximately equal to a quarter wavelength ($\lambda/4$, where $\lambda$ is a wavelength) of an electromagnetic wave having a selected frequency. For example, in a bicone antenna designed to have a center frequency of 650 MHz, the base of each element is approximately four and a half inches (i.e., $\lambda/4$=four and a half inches) and the height of each element is approximately the same.

Although, the bicone antenna 100 performs satisfactorily for impulse radios, further improvement is still desired. One area in which improvement is desired is reduction of unbalanced currents on the feed cable, e.g., a coaxial type cable, of a wide-band antenna. Generally, impulse radios operate at extremely high frequencies, typically at 1 GHz or higher. At such high frequencies, currents are excited on the outer feed cable because of the fields generated between the center conductor and the outside conductor. These currents are unbalanced having poorly controlled phase, thereby resulting in distorted ultra-wideband pulses. Such distorted ultra-wideband pulses have low frequency emissions that degrade detectability and cause problems in terms of frequency allocation.

Generally, unbalanced currents on feed cables are filtered by balun transformers or RF chokes. However, at frequencies of 1 GHz or higher, it is extremely difficult to make balun transformers or RF chokes, due to degraded performance of ferrite materials. Furthermore, balun transformers suitable for use in ultra-wideband systems are difficult to design. As a result, unbalanced currents remain a concern in the design of ultra wide-band antennas.

A second area where improvement is desired is the isolation of a transmitter from a receiver in an ultra-wideband communications system. Because the bicone antenna 100 generates a field pattern that is omni-directional in the azimuth, it is difficult to isolate a transmitter from a receiver. Additionally, isolation between antennas is desired where a plurality of antennas are arranged in an array. In an array system, isolation significantly reduces loading of one element by an adjacent element.

For these reasons, many in the ultra-wideband communications environment has recognized a need for an improved antenna that provides a significant reduction in unbalanced currents in feed cables. There is also a need for an antenna suitable for ultra-wideband communication systems that provides improved isolation between transmitters and receivers as well as between antenna elements in an array system.

SUMMARY OF THE INVENTION

The present invention is directed to an ultra-wideband magnetic antenna. The antenna includes a planar conductor having a first and a second symmetrical slot about an axis. The slots are substantially leaf-shaped having a varying width along the axis. The slots are interconnected along the axis. A pair of terminals are located about the axis, each terminal being on opposite sides of said axis.

The present invention provides a significant reduction in unbalanced currents on the outer feed cables of the antenna, which reduces distorted and low frequency emissions. More importantly, reduction of unbalanced currents eliminates the need for balun transformers in the outer feed cables.

In one embodiment of the present invention, a cross polarized antenna system is comprised of an ultra-wideband magnetic antenna and an ultra-wideband regular dipole antenna. The magnetic antenna and the regular dipole antenna are positioned substantially close together and they create a cross polarized field pattern.

Furthermore, the present invention provides isolation between a transmitter and a receiver in an ultra-wideband system. Additionally, the present invention allows isolation among radiating elements in an array antenna system.

Further features and advantages of the present invention, as well as the structure and operation of various embodiments of the present invention, are described in detail below with reference to the accompanying drawings.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE EMBODIMENTS

1. Overview and Discussion of the Invention

The present invention is directed to an ultra-wideband magnetic antenna. Generally, a magnetic antenna is constructed by cutting a slot of the shape of an antenna in a conducting plane. The magnetic antenna, also known as a complementary antenna, operates under the principle that the radiation pattern of an antenna is the same as that of its complementary antenna, but that the electric and magnetic fields are interchanged. The radiation patterns have the same shape, but the directions of E and H fields are interchanged. The relationship between a regular antenna and its complementary magnetic antenna is illustrated in FIGS. 2–4.

Figure 2:
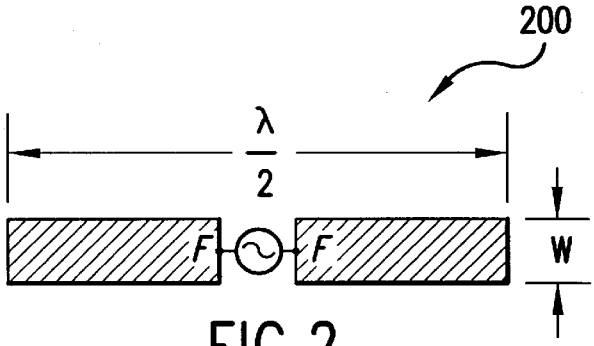
FIG. 2 illustrates a half-wave-length dipole antenna.

FIG. 2 shows a half wave-length dipole antenna 200 of width w being energized at the terminals FF as indicated in the figure. The antenna 200 consists of two resonant $\lambda/4$ conductors connected to a 2-wire transmission line.

Figure 3:
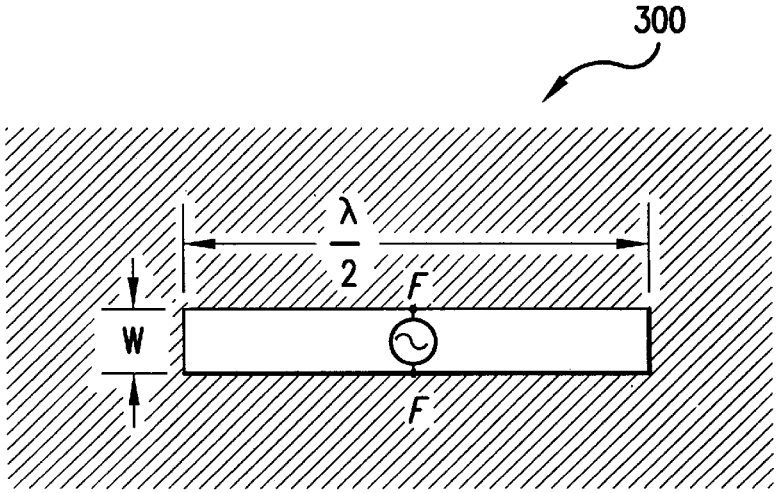
FIG. 3 illustrates a complementary magnetic antenna.

FIG. 3 is a complementary magnetic antenna 300. In this arrangement, a $\lambda/2$ slot of width w is cut in a flat metal sheet. The antenna 300 is energized at the terminals FF as indicated in FIG. 3.

Figure 4A:
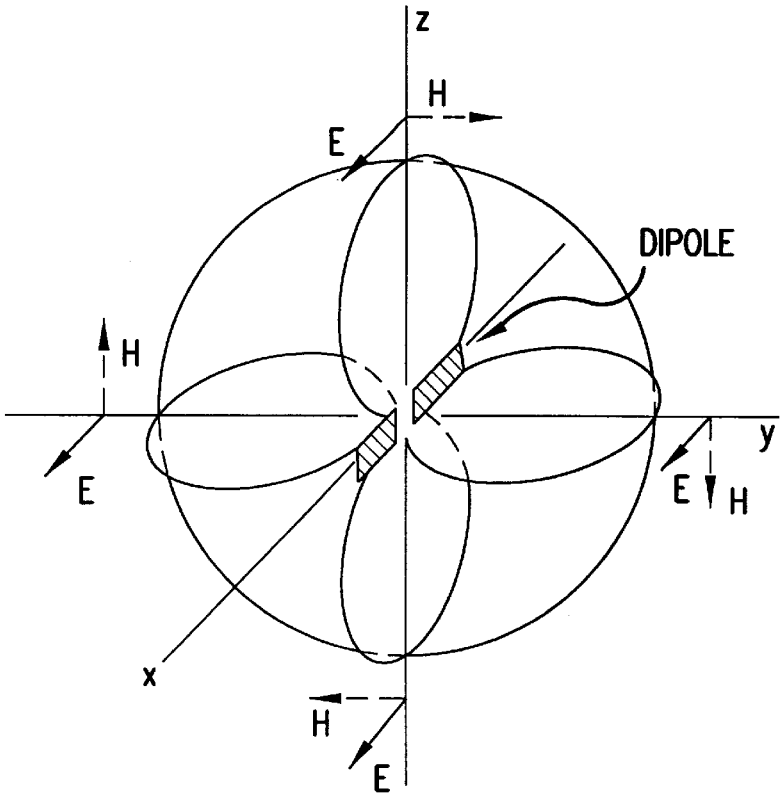
FIGS. 4A and 4B show the field patterns of the antennas of FIGS. 2 and 3.
Figure 4B:
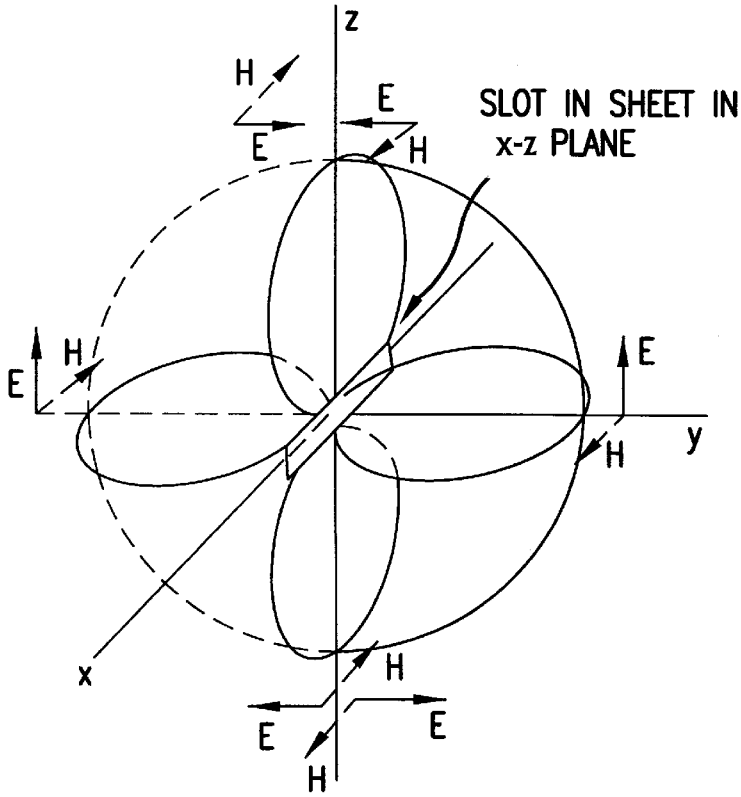

The patterns of the antenna 200 and the complementary antenna 300 are compared in FIG. 4. FIG. 4A shows the field pattern of the antenna 100 and FIG. 4B shows the field pattern of the complementary antenna 300. The flat conductor sheet of the complementary antenna is coincident with the xz plane, and the long dimension of the slot is in the x direction. The dipole is also coincident with the x axis as indicated. The field patterns have the same shape, as indicated, but the directions of E and H are interchanged. The solid arrows indicate the direction of the electric field E and the dashed arrows indicate the direction of the magnetic field H.

2. The Invention

Figure 5:
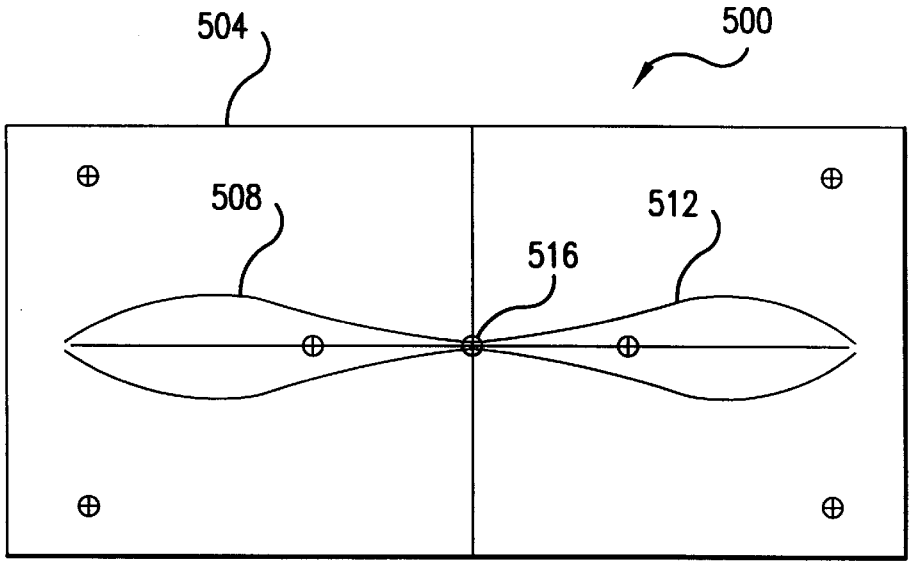
FIG. 5 illustrates a complementary magnetic antenna in accordance with one embodiment of the present invention.

FIG. 5 illustrates a complementary magnetic antenna 500 in accordance with one embodiment of the present invention. The antenna 500 includes a planar conductor 504, a pair of leaf-shaped slots 508 and 512, and terminals 516.

The planar conductor 504 is shown to be rectangular, although other shapes are also possible. It is constructed of copper, aluminum or any other conductive material. The leaf-shaped slots 508 and 512 are positioned symmetrical to a horizontal axis A—A and vertical axis B—B. The slots are interconnected at the vertical axis B—B. The terminals 516 are located at the vertical axis B—B. The antenna 500 is energized at the terminals 516 by a feed cable such as a coaxial cable (not shown). In one embodiment of the present invention, the length and width of the planar conductor 504 is set at $\lambda_c/2$ and $\lambda_c/4$, respectively, where $\lambda_c$ is the wavelength of the center frequency of a selected bandwidth. Actually, the length and the width of the planar conductor 504 should preferrably be at least $\lambda_c/2$ and $\lambda_c/4$ in order to prevent the antenna 500 from becomming a resonant antenna. In fact, the greater the length and the width of the planar conductor 504, the less resonant the antenna 500 will be.

The bandwidth of the antenna 500 is primarily determined by the shape of the slots 508 and 512 and the thickness of the planar conductor 504 around the slot. Both the shape of the slot and the thickness of the planar conductor 504 around the slot was experimentally determined by the inventor.

Figure 6:
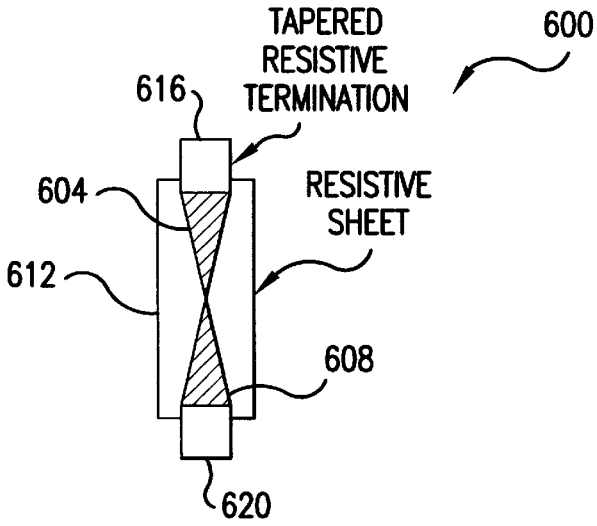
FIG. 6 illustrates a resistively tapered bowtie antenna.

In the past, the inventor has experimented with dipole antennas, such as the resistively tapered bowtie antenna 600 shown in FIG. 6. Specifically, the antenna 600 comprises radiators 604 and 608, resistor sheet 612, and tapered resistive terminators 616 and 620. The tapered resistive terminators 616 and 620 create smooth transitions along the edges of the antenna 600.

The resistor sheet 612 helps absorb some of the current flowing to the end of the dipole. The resistive loading dampens the signal so that the antenna 600 is less resonant and therefore, has a broader band-width. There is, however, a disadvantage; the resistive loading causes resistive loss which is dissipated as heat. In other words, the bandwidth of the antenna 600 is increased by resistive loading, but which also lowers the antenna radiation efficiency. The resistive loading results in an increasing impedance as the signal approaches the tip of the antenna 600. The signal reflects all along the tapered edge and not just the tip. This spreads the resonance in much the same manner as a tapered transmission line impedance transformer.

From these experiments, it was recognized that smooth transitions in the shape of the dipole is an important factor in minimizing resonance, thereby increasing bandwidth. It was also recognized that one way to achieve smooth transitions would be to select a function that describes the shape of the dipole and its derivative as continuous as possible. Using empirical methods, a combination of exponential functions was initially selected to describe the shape of the dipole antenna.

Later, this concept was applied to a complementary magnetic antenna. It was hypothesized that creating a smooth and continuous shape of the slot of a complementary magnetic antenna would result in an ultra-wideband antenna. Since the complement of the tapered bow-tie antenna had an unacceptably high input impedance (approximately 170 ohms), other shapes were investigated.

Thereafter, a product of cosine functions were selected which ensured that their derivatives are also continuous. The inventor empirically developed the equation $$f(l) = \frac{\cos[l\pi](1 - \cos[l\pi])}{4},$$

where f(l) is the width of the slot and l is the length of the slot. This equation provided a symmetric shape of the slot, thus resulting in a symmetric field pattern. Moreover, the antenna had an approximately 50 ohm impedance that is also the impedance of many coaxial cables, thereby eliminating the need for a standard balun transformer that is serving as an impedance transformer. Furthermore, the antenna could be easily modified to match a 70 ohm impedance by increasing the width of the gap slightly.

The width of the conductor around the slot is determined by several factors. An ideal wideband complementary antenna has an infinite conductor sheet, while a narrow band loop antenna is constructed from a wire. Because an important objective of the present invention was to make the overall size of the antenna relatively small, the width of the conductor around the slot was reduced until the antenna began to resonate unacceptably. It was discovered that these resonances occurred when the tip of the slot was less than ¼ inches from the edge of the conductor and the edge of the slot was less than 1 inch from the side of the conductor. It was hypothesized that a narrow conductor restricts the flow of current such that it performs like a loop radiator. In contrast, a broad conductor allows a family of loop currents, each having a distinct frequency, to flow around the slot, resulting in a ultra wide-band radiator. Based on the foregoing observations, an example embodiment of the antenna 500 was constructed having the following dimensions:

| | |
|---|---|
| length of the conductor plate 500 | 5.25 inches |
| width of the conductor plate 504 | 2.5 inches |
| combined length of slots 508 and 512 | 4.6 inches |
| maximum width of slots 508 and 512 | 0.62 inches |

Figure 7:
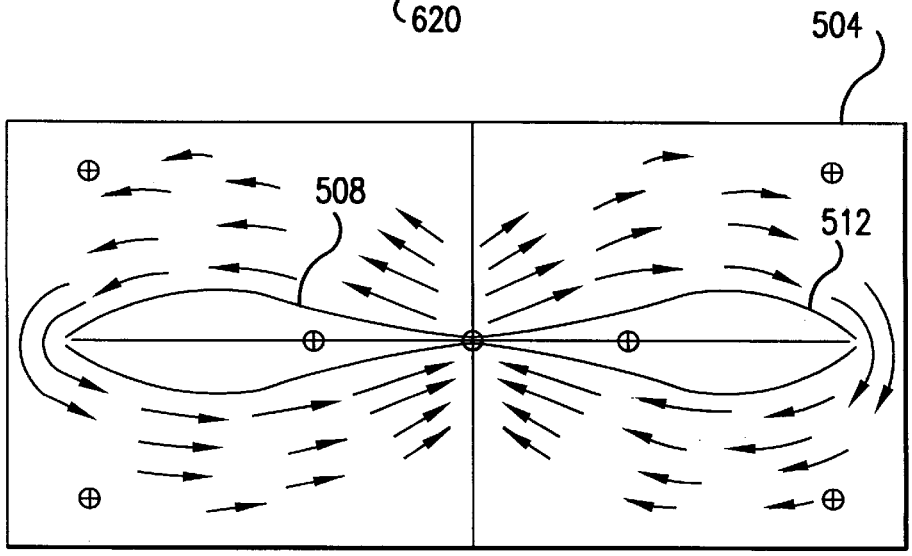
FIG. 7 shows surface currents on the antenna of FIG. 5.

FIG. 7 shows the direction of surface currents (shown by a series of arrows) on the conductor plate 504. As indicated in FIG. 7, the surface currents originate at one of the terminals, flow around the slots 508 and 512 and thereafter terminate at the other terminal. Thus, the surface currents form a series of loops around the slots 508 and 512.

The antenna 500 offers several advantages over existing broad-band antennas. As noted previously, impulse radios and other ultra-wideband communication systems typically operate at extremely high frequencies, e.g., 1 GHz or higher. At such high frequencies, unbalanced currents are excited on the outer feed cable because of the fields generated between the center conductor and the outside conductor of a coaxial cable. The unbalanced currents degrade detectability and frequency allocation.

In the past, unbalanced currents on feed cables were filtered (i.e., attenuated or blocked) by balun transformers or choked by ferrite beads or cores (ferrite beads or cores produce high impedance junction around feed cables). However, at operating frequencies of 1 GHz or higher, it is extremely difficult to make balun transformers or ferrite cores due to the performance of ferrite materials at these frequencies. An important advantage of the present invention is that the unbalanced currents are almost negligible on outer feed cables.

Generally, in a regular dipole antenna having two radiating elements, the first radiating element is driven against the second radiating element (the ground side). The first radiating element is isolated from the second radiating element by an air gap or some other dielectric medium. This produces an electric field in the gap between the inner conductor and the outer conductor of the coaxial cable, thereby inducing unbalanced currents therein. In contrast, in a magnetic dipole antenna, both the slots are electrically connected by the surrounding conductor plate. For example, as indicated in FIG. 5, the slots 508 and 512 are electrically connected to each other by the surrounding conductor plate 504. Thus, unlike in a regular dipole antenna, one element of a magnetic antenna is not driven against another element of the magnetic antenna. This reduces unbalanced currents to a negligible level, thereby eliminating the need for ferrite cores in the outer feed cables.

Another important feature of the present invention is that it can be used to construct a cross polarized antenna system. As noted before, the present invention is a magnetic antenna, and thus, its radiation patterns have the same shape as the radiation patterns of its complementary dipole antenna, but the directions of E and H are interchanged. This allows the construction of a cross polarized antenna system by positioning an ultra-wideband dipole antenna and a complementary magnetic antenna side by side, while keeping the form factor fairly small and their phase centers close together. Such a cross polarized system can be used in cross polarized feeds for channelization and ground penetrating radars. Additionally, a cross polarized antenna system can provide polarization diversification. Several embodiments of cross polarized systems are briefly described, infra.

Figure 8:
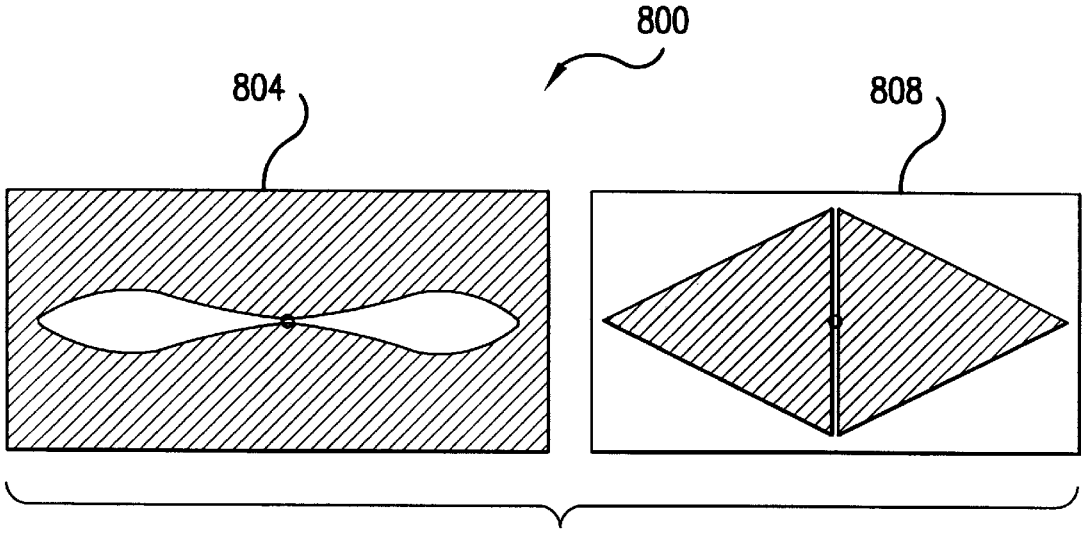
FIGS. 8 and 9 show cross polarized antenna systems in accordance with the present invention.
Figure 9:
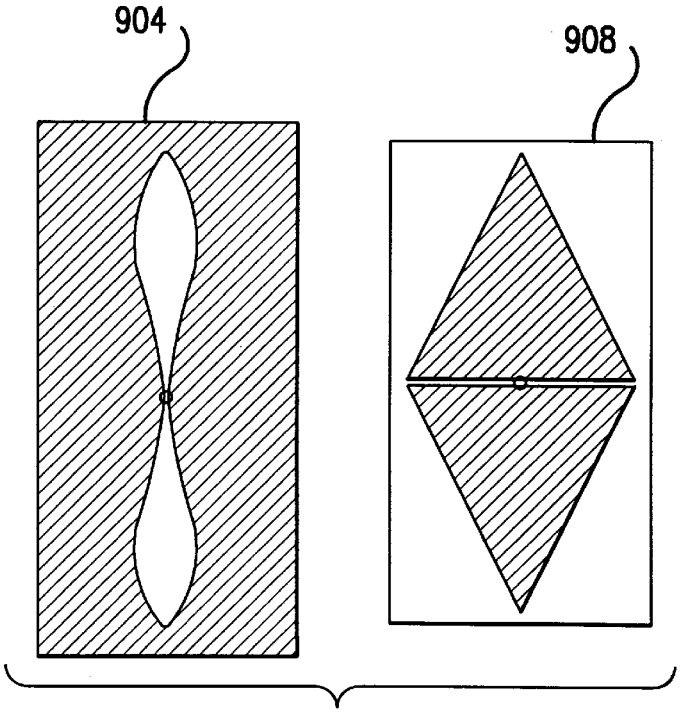
Figure 10:
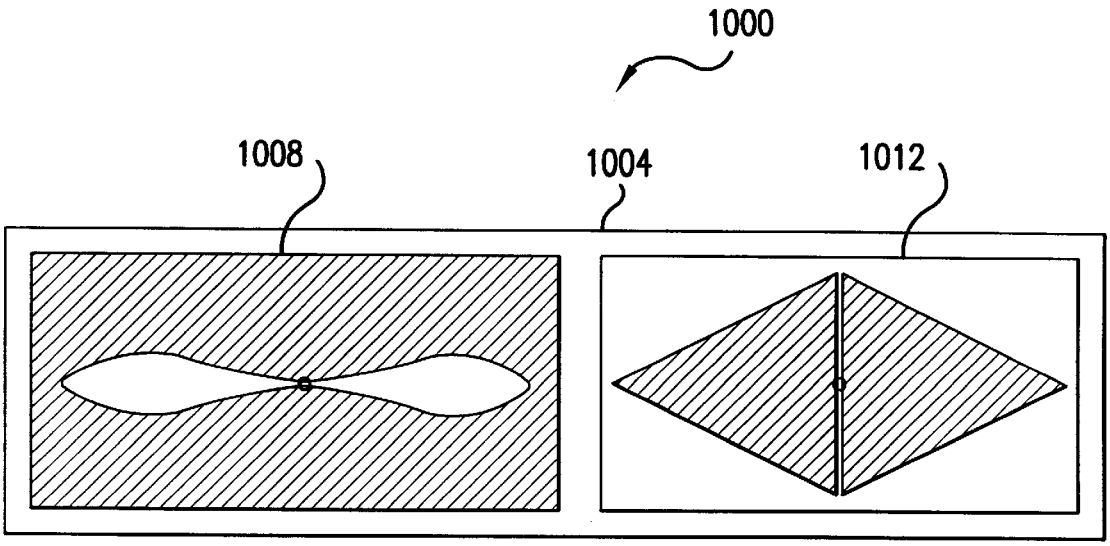
FIG. 10 shows a cross polarized antenna system with a back reflector.

FIG. 8 shows a cross polarized antenna system 800 according to one embodiment of the present invention. As indicated in FIG. 8, the cross polarized antenna system is comprised of an ultra wide-band magnetic antenna 804 and an ultra-wideband dipole antenna 808 positioned end to end. Another embodiment of a cross polarized antenna is shown in FIG. 9. In this embodiment, an ultra wide-band magnetic antenna 904 and an ultra-wideband dipole antenna 908 are positioned side by side. In both these embodiments, additional gain can be obtained by placing a back reflector. FIG. 10 shows a cross polarized antenna system 1000 having a back reflector 1004. The back reflector 1004 also provides improved directionality by producing field patterns on only one side of the antenna system 800.

Figure 11:
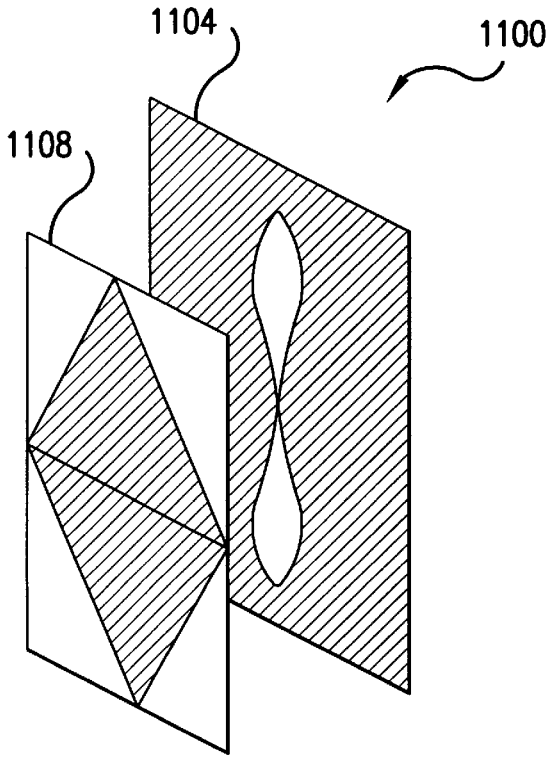
FIG. 11 shows another embodiment of the cross polarized antenna system.

FIG. 11 shows yet another embodiment of a cross polarized antenna system 1100 in accordance with the present invention. As indicated in FIG. 11, an ultra-wideband magnetic antenna 1104 is placed facing an ultra-wideband dipole antenna 1108. Since the antenna 1104 comprises a conductor plate, it acts as a back reflector to the antenna 1108. The net result is a highly compact ultra wide-band cross polarized antenna that can also be used to feed a parabolic dish. The spacing between the antennas is based on empirical measurements. Specifically, the ultra-wideband antenna requires a 0.44 λ gap in order to maximize the peak signal. Experimental results have indicated that the cross polarized antenna system 1100 performed satisfactorily. Although conventional wisdom would indicate that the antenna 1108 would block signals from the antenna 1104, it was discovered that the cross polarized antenna system 1100 performed satisfactorily. This is attributed to the fact that the polarization of both the antennas' 1104 and 1108 are linear even though each antenna has a planar structure.

Figure 1:
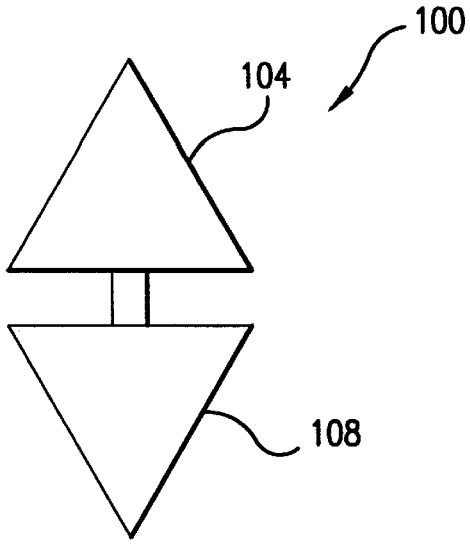
FIG. 1 illustrates a front view of a bicone antenna.

Yet another feature of the present invention is that it allows isolation of a transmitter from a receiver. As noted before, the bicone antenna of FIG. 1 generates a field pattern that is omni-directional in the azimuth, thereby making it difficult to isolate a transmitter from a receiver. Since the magnetic antenna 500 according to the present invention produces a null in the conductor plate 504, a transmitter and a receiver can be appropriately placed so that they are isolated from one another. This feature is also useful in array systems where it is often desirable to isolate one antenna element from another in order to prevent electromagnetic loading by adjacent elements. Because the antenna 500 does not radiate from the side (due to the null along the A—A axis in FIG. 5), it reduces loading by adjacent elements, thereby significantly improving the performance.

Figure 12:
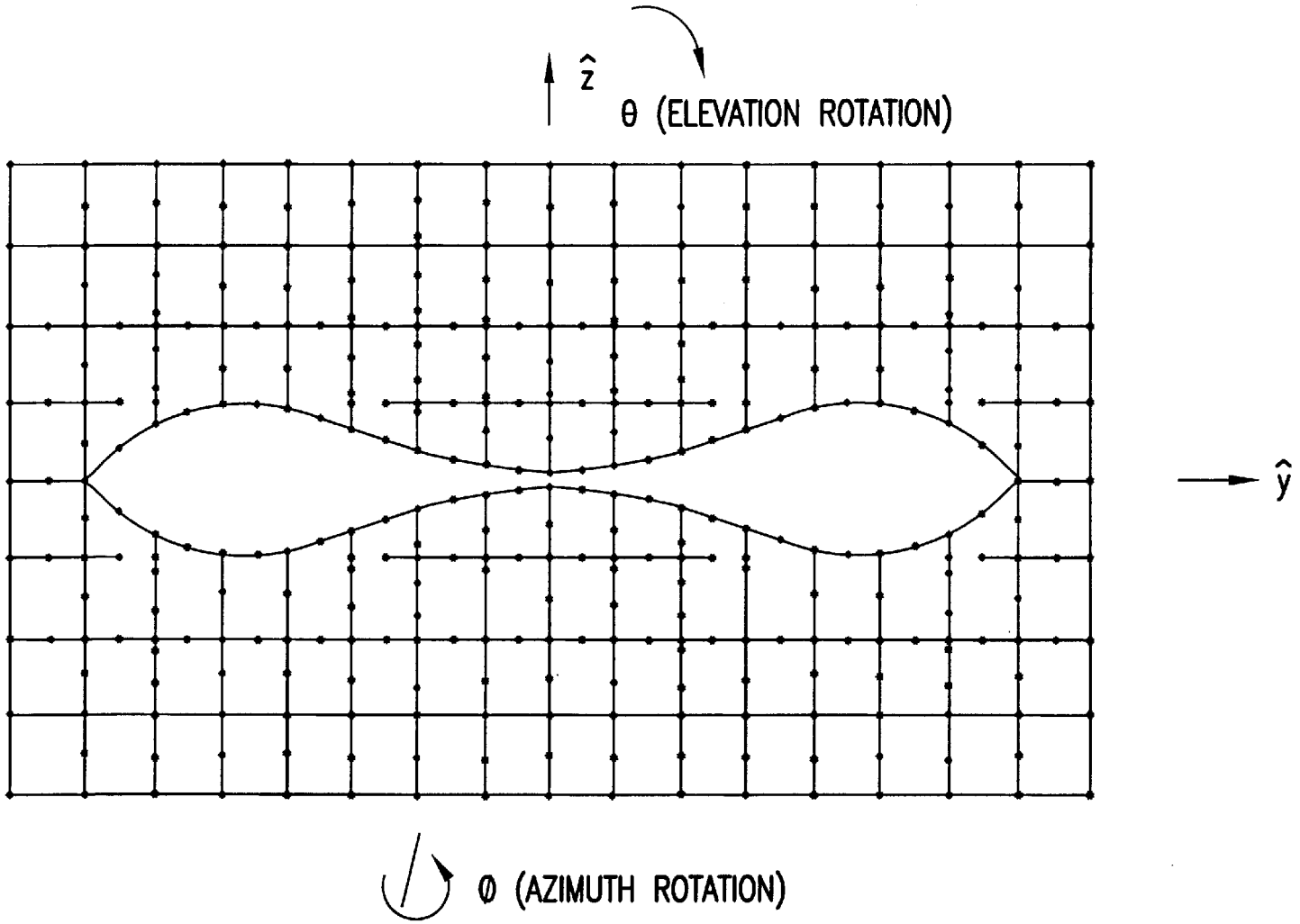
FIG. 12 shows a complementary magnetic antenna constructed from a grid used for NEC simulation.
Figure 13:
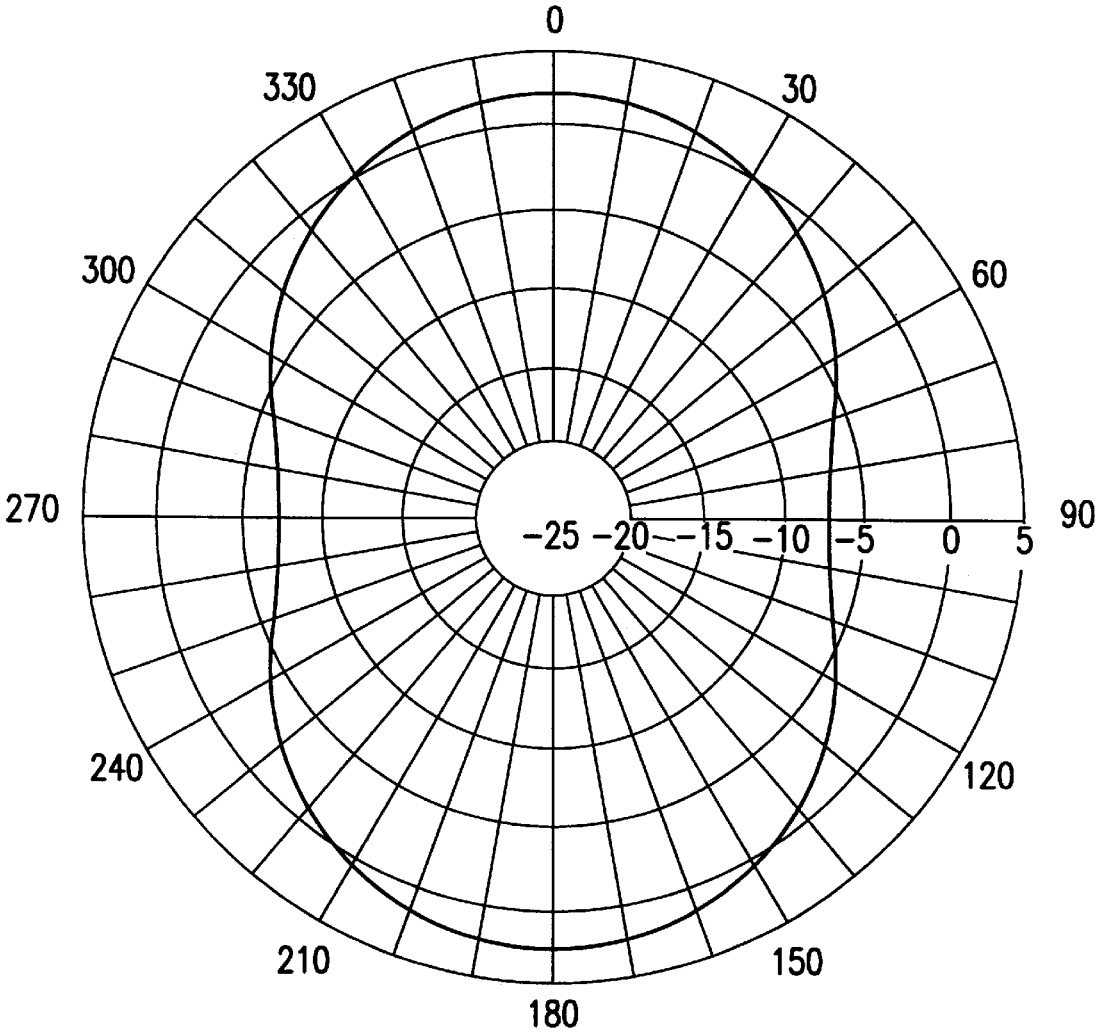
FIG. 13 shows a simulated azimuth pattern of the antenna of FIG. 12.
Figure 14:
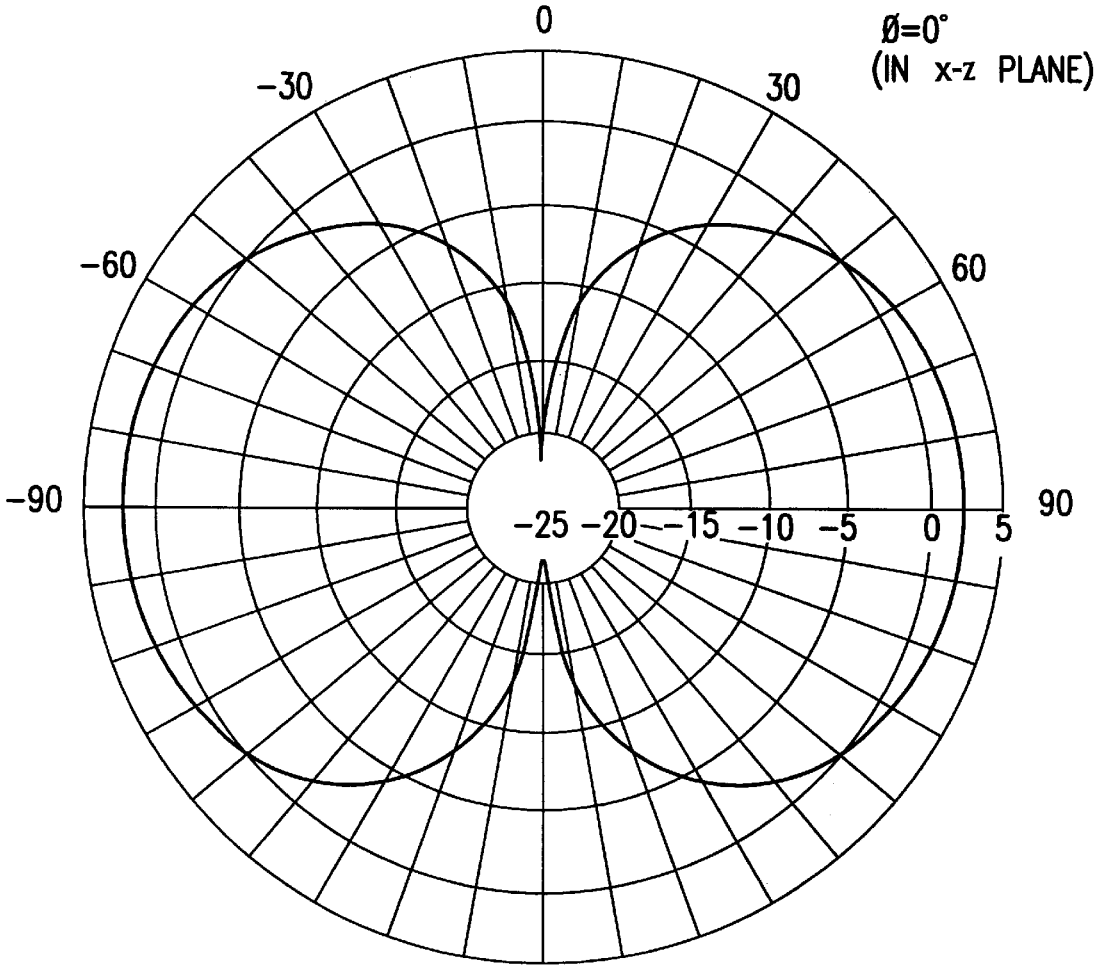
FIGS. 14 and 15 show simulated elevation patterns of the antenna of FIG. 12 in the x-z plane and y-z plane, respectively.
Figure 15:
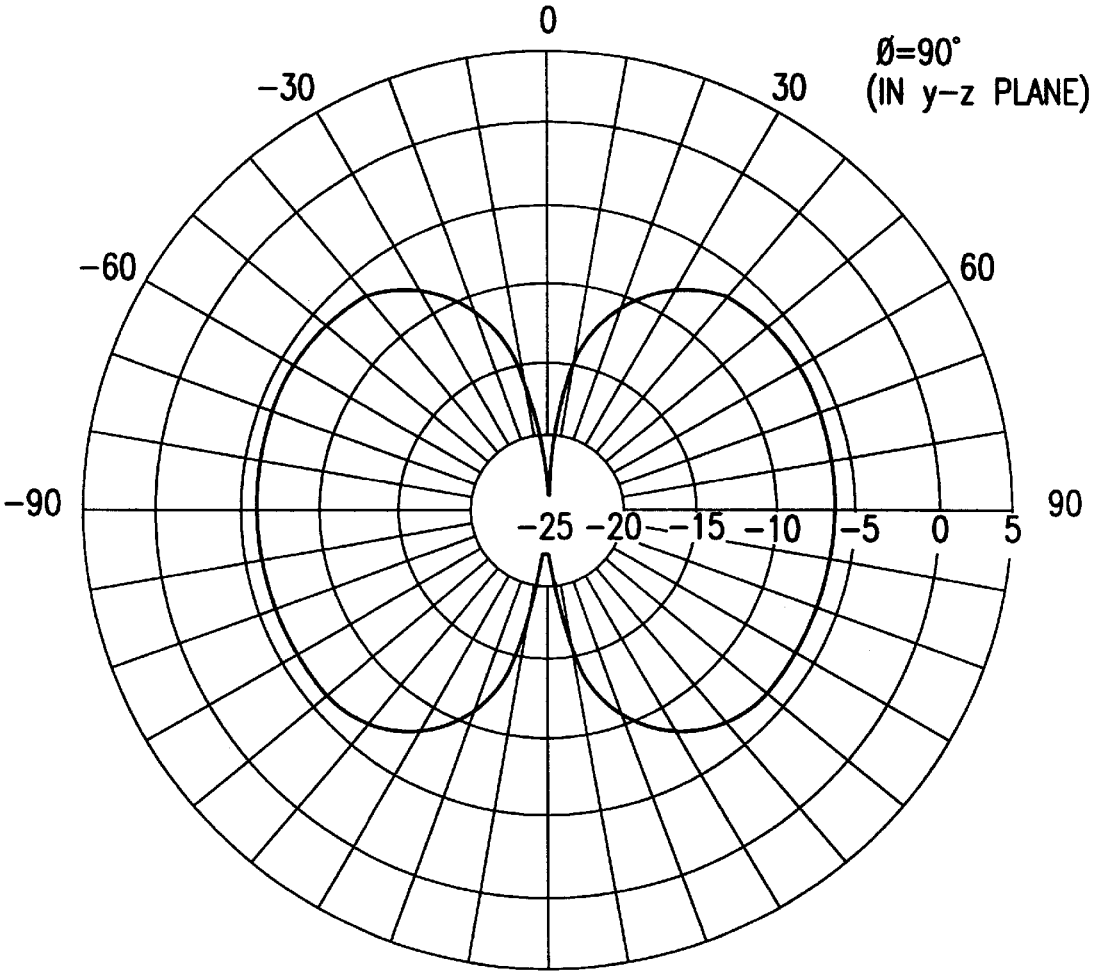

FIG. 12 shows a complementary magnetic antenna 1200 in accordance with the present invention constructed from a grid that was used for NEC (numeric electromagnetic code) simulation (a moment method simulation). The NEC simulation can be used to simulate the field patterns of the antenna 1200. FIG. 13 shows the simulated azimuth pattern of the antenna 1200. Experimental results of the azimuth pattern indicated that the antenna 1200 has a peak to trough ratio of approximately 9 dB and HPBW of approximately 60 degrees. Thus, the simulation results closely correspond to the experimental results. FIG. 14 shows the simulated elevation pattern of the antenna 1200 in the x-z plane. Experimental results of the elevation pattern indicated that the antenna 1200 has a HPBW of approximately 70 degrees that closely corresponds to the simulation results. Finally, FIG. 15 shows the simulated elevation pattern of the antenna 1200 in the y-z plane.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

In the claims:

1. An ultra wide-band magnetic antenna, comprising:

a planar conductor having a first and a second slot, said first and second slots placed about an axis and being interconnected along said axis, said first and second slots having a width along said axis that varies substantially continuously from a central point to a distal end of each slot; and a pair of terminals located about said axis, wherein, said magnetic antenna transmits electromagnetic waves when energized at said terminals, and wherein, said magnetic antenna generates a signal across said terminals when excited by electromagnetic waves.

2. The magnetic antenna according to claim 1, wherein said first and second slots are placed symmetrically about said axis.

3. The magnetic antenna according to claim 1, wherein said first and second slots are placed asymmetrically about said axis.

4. The magnetic antenna according to claim 1, wherein said terminals are located approximately at the mid point of said axis where said first and second slots are interconnected.

5. The magnetic antenna according to claim 1, wherein the width w of said first and second slots are defined by the equation $$w = \frac{1}{4\mathrm{Cos}[l\pi](1 - \mathrm{Cos}[l\pi])},$$

wherein said w is defined as the perpendicular distance between a point on the edge of said slot and said axis and l is the length of said slot.

6. The magnetic antenna according to claim 1, wherein said planar conductor sheet having a length of at least $\lambda_c/2$ and width of at least $\lambda_c/4$, where $\lambda_c$ is a wavelength of the center frequency of a selected bandwidth.

7. A cross polarized antenna system comprising:

an ultra-wideband magnetic antenna, said magnetic antenna radiating a first E field and a first H field, wherein said magnetic antenna comprises a planar conductor having a first and a second slot, said first and second slots placed about an axis and being interconnected along said axis, said first and second slots having a width along said axis that varies substantially continuously from a central point to a distal end of each slot, and a pair of terminals located about said axis such that said magnetic antenna transmits and receives electromagnetic waves when energized at said terminals and generates a signal across said terminals when excited by electromagnetic waves; and an ultra-wideband electric antenna, said electric antenna radiating a second E field and a second H field;

wherein, said magnetic antenna and said electric antenna are positioned substantially close to each other, said first E field and first H field being substantially orthogonal to said second E field and said second H field, thereby creating a cross polarized field pattern.

8. The magnetic antenna according to claim 7, wherein the magnetic antenna further comprising:

a planar conductor sheet having a first and a second slot, said first and second slots being substantially leaf-shaped, said first and second slots placed symmetrically about an axis and further being interconnected along said axis; and a pair of terminals located about said axis, wherein, said magnetic antenna transmits electromagnetic waves when energized at said terminals, and wherein, said magnetic antenna generates a signal across said terminals when excited by electromagnetic waves.

9. The electric antenna of claim 7, further comprising:

a first planar conductor substantially triangular having two sides and a base;

a second planar conductor substantially triangular having two sides and a base, said first planar conductor and said second planar conductor placed so that their bases are substantially close to each other; and a pair of terminals, each located at one of said conductor sheet, wherein, said electric antenna transmits electromagnetic waves when energized at said terminals, and wherein, said electric antenna generates a signal across said terminals when excited by electromagnetic waves.

10. The cross polarized antenna system of claim 7, further comprising a third planar conductor placed substantially close to said first and second planar conductors.

11. The cross polarized antenna of claim 7 wherein said first and said second planar conductor are co-planar.

12. The cross polarized antenna of claim 7 wherein said third planar conductor is parallel to said first and second planar conductors.

13. A cross polarized antenna system comprising:

an ultra-wideband magnetic antenna, said magnetic antenna radiates a first E field and a first H field, wherein said magnetic antenna comprises a planar conductor having a first and a second slot, said first and second slots placed about an axis and being interconnected along said axis, said first and second slots having a width along said axis that varies substantially continuously from a central point to a distal end of each slot, and a pair of terminals located about said axis such that said magnetic antenna transmits and receives electromagnetic waves when energized at said terminals, and generates a signal across said terminals when excited by electromagnetic waves; and an ultra-wideband electric antenna, said electric antenna radiates a second E field and a second H field, said electric antenna being spaced from said magnetic antenna and facing said magnetic antenna;

wherein, said first E field being substantially orthogonal to said second E field and said first H field being substantially orthogonal to said second H field, thereby creating a cross polarized field pattern.

14. The cross polarized antenna according to claim 13, wherein said electric antenna and said magnetic antenna are substantially parallel to each other.

* * * * *

UNITED STATES PATENT AND TRADEMARK OFFICE

CERTIFICATE OF CORRECTION

PATENT NO. : 6,091,374
DATED : July 18, 2000
INVENTOR(S) : Mark Andrew Barnes

It is certified that error appears in the above-identified patent and that said Letters Patent is hereby corrected as shown below:

Title page,
Item [56], please add the following cited references:

| | | | | |
|---|---|---|---|---|
| -- | 2,935,747 | 3/56 | Ghose | 343/767 |
| | 3,623,162 | 7/24 | Whitty | 343/767 -- |

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*